US005617880A

United States Patent [19]

Landuydt

[11] Patent Number: 5,617,880

[45] Date of Patent: Apr. 8, 1997

[54] ASHTRAY WITH CIGARETTE EXTINGUISHER

[76] Inventor: Louis Landuydt, 925, boul. Laird, Suite 411, Montreal, Quebec, Canada, H3R 1Y9

[21] Appl. No.: 655,792

[22] Filed: May 30, 1996

[51] Int. Cl.[6] ..... A24F 19/14

[52] U.S. Cl. ..... 131/237; 131/256; 131/231; 131/235; 131/241

[58] Field of Search ..... 131/256, 231, 131/240.1, 241, 206, 235, 240 R, 237; D27/102

[56] References Cited

U.S. PATENT DOCUMENTS 2,779,341 1/1957 Smile ..... 131/237

2,790,446 1/1957 Smile ..... 131/237

2,996,068 8/1961 Bosko et al. ..... 131/237

*Primary Examiner*—Vincent Millin

*Assistant Examiner*—Charles W. Anderson

*Attorney, Agent, or Firm*—François Martineau

[57] ABSTRACT

The device comprises a receptacle for receiving ash and cigarette butts, a receptacle closure pivoted to the upper end of the receptacle and biased to closed position, a tubular cigarette extinguisher carried by the receptacle closure and an extinguisher closure for closing the cigarette outlet end of the extinguisher. Both closures open and close simultaneously and the cigarette outlet is directed toward the inside of the receptacle. A cigarette inserted into the extinguisher and abutting the extinguisher closure becomes extinguished. The extinguished cigarette is automatically discharged into the receptacle upon manually opening the receptacle closure.

10 Claims, 2 Drawing Sheets

ASHTRAY WITH CIGARETTE EXTINGUISHER

FIELD OF THE INVENTION

The present invention relates to an ashtray provided with a cigarette extinguisher.

BACKGROUND OF THE INVENTION

It is known to provide an ashtray in the form of a receptacle for storing cigarette butts and ashes and provided with an openable cover to seal the receptacle against emission of bad cigarette odours.

It is also known to provide a cigarette extinguisher consisting of a tube closed at its lower end into which a cigarette is inserted to extinguish the same for lack of oxygen.

In all known ashtrays provided with such a cigarette extinguisher, whether they are ashtrays provided or not with a sealing cover, the cigarette, once extinguished, must be manually removed from the extinguisher to be dropped into the ashtray or otherwise disposed of.

OBJECTS OF THE INVENTION

It is the general object of the present invention to provide an ashtray having both a sealing cover and a cigarette extinguisher, in which the extinguished cigarette is automatically discharged from the extinguisher into the ashtray upon opening of the cover.

Another object of the present invention is to provide an ashtray cover and cigarette extinguisher unit which is easily and quickly manipulated to discharge the ashes and the cigarette butts into the storage compartment of the ashtray.

Another object of the present invention is to provide an ashtray of the character described of simple and inexpensive and yet ornamental construction.

SUMMARY OF THE INVENTION

The device of the invention comprises an ash and cigarette butts receptacle having a receptacle upper portion, a receptacle closure, pivot means for pivoting said receptacle closure to said receptacle upper portion for pivoting between a closed position closing said receptacle and an open position giving access to said receptacle, biasing means biasing said cover to closed position, a tubular cigarette extinguisher carried by said receptacle closure and having an inlet end and an outlet end directed toward the inside of said receptacle, and an extinguisher closure at said outlet end, said extinguisher closure closing said outlet end when said receptacle closure is in closed position and opening said outlet end when said receptacle closure is in open position whereby a cigarette can be inserted into said tubular extinguisher to abut said extinguisher closure and become extinguished when both closures are in closed position and the extinguished cigarette can be discharged from said extinguisher through said outlet end directly into said receptacle when said first closure is in open position.

Preferably, biasing means are formed by the offset of the centre of gravity of said receptacle closure relative to said pivot means.

In a first embodiment of the invention, said receptacle closure is a single cover plate and said tubular extinguisher is a tube having fully opened inlet and outlet ends and downwardly depending from one end of said cover plate and said extinguisher closure is a closure plate secured to and extending within said receptacle below said cover plate and in a position closing the outlet end of said tube when said cover plate is in receptacle closing position, said outlet end directed towards the inside of said receptacle and sufficiently spaced from said closure plate to permit said cigarette discharge when said cover plate is in open position.

Preferably, the pivot axis of the cover plate is transverse to the front and back walls of the receptacle and a cigarette passage is defined between said closure plate and said front wall and said outlet end abuts said closure plate when said cover plate is in closed position and is aligned with said passage when said cover plate is in open position.

Preferably, said cover plate has a front and a back portion at an angle to each other, said tube is carried by and downwardly depend from said front portion, and said back portion is downwardly inclined away from said front portion and abuts said back wall and said front portion abuts said front wall when said cover plate is in closed position.

Preferably, said closure plate has side flanges upwardly extending from opposite sides thereof and said receptacle has side walls with which said side flanges of said closure plate are in slidable contact.

Preferably, at least one of side walls has a top notch exposing the upper part of one of said side flanges to permit a user's finger to press down on said exposed upper part and pivot said closure plate to open position.

Preferably, said receptacle has a rectangular planar cross-section with said front and back walls being narrower than said side walls, and said pivot means including pivot studs outwardly protruding from the upper part of said side flanges of said closure plate and pivot notches at the upper edges of said side walls releasably receiving said pivot studs whereby said cover plate and depending tube can be bodily removed from said receptacle.

In a second embodiment of the invention, said receptacle closure is composed of a pair of contiguous cover plates respectively pivoted onto said receptacle by said pivot means, said cover plates having junction edges which join to form a closed joint in the closed position of said receptacle closure and which are spaced apart in the open position of said receptacle closure, said extinguisher is formed of two similar semi-tubular portions and said second closure is formed of two similar half closure plates normal to and fixed to the lower end of the respective semi-tubular portions and said semi-tubular portions and half closure plates having junction edges which join to form a closed joint in the closed position of said receptacle closure and which are spaced apart in the open position of said receptacle closure.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
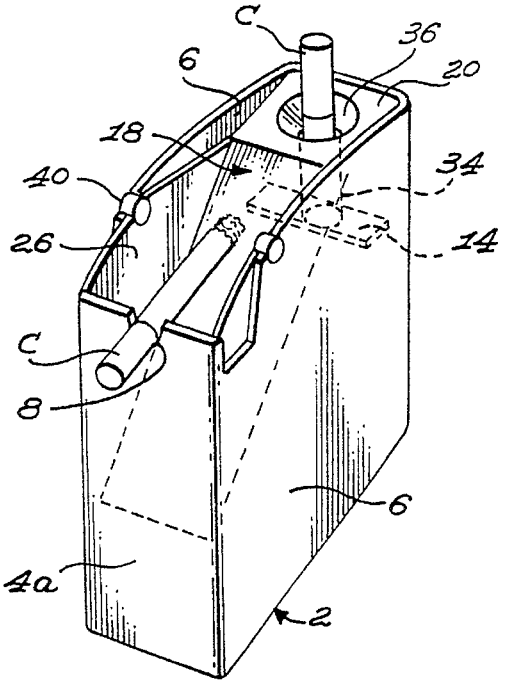
FIG. 1 is a perspective view of a first embodiment of the ashtray with a sealing cover and cigarette extinguisher unit in accordance with the invention.
Figure 3:
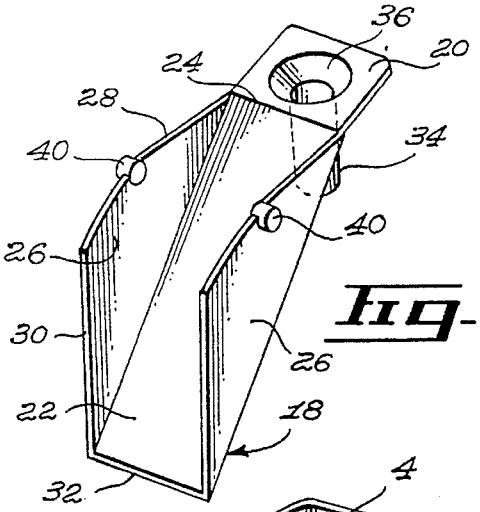
FIG. 3 is a perspective view of the sealing cover and cigarette extinguisher tube.
Figure 2:
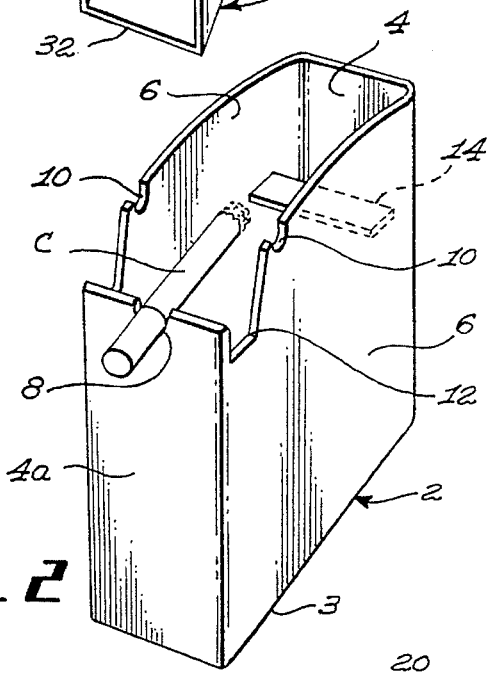
FIG. 2 is a perspective view of the receptacle.

The first embodiment is illustrated in FIGS. 1 to 5. This embodiment comprises an open top ash and cigarette butt storing receptacle 2 of generally rectangular shape when seen in plan view and including a bottom wall 3, narrower front and back end walls 4 and 4*a* respectively and wider side walls 6. The top edge of the back end wall 4*a* has a cigarette holding notch 8 while the top edges of the side walls 6 are provided with a pair of transversely aligned pivot notches 10 disposed nearer back end wall 4*a*. Side walls 6 are also formed at their top edge with a pair of transversely aligned finger receiving notches 12 disposed adjacent back end wall 4*a* rearwardly of notches 10.

A cigarette extinguisher closure plate 14 is secured within receptacle 2. More particularly, it extends across receptacle 2 from one side wall 6 to the other being parallel to bottom wall 3 so as to be horizontal when the ashtray is on a table or the like horizontal supporting surface. Closure plate 14 is spaced from the front end wall 4 to define a passage 16 for a cigarette butt discharged from the extinguisher tube. Closure plate 14 is located at a measured distance below the top edge of front end wall 4.

A cover plate 18 serves to seal the top of receptacle 2 to prevent emission of bad odours from ashes and cigarette butts stored in the bottom of receptacle 2. Cover plate 18 is of generally rectangular shape and is formed of a front portion 20 and back portion 22 at an angle to each other and integrally joined by an intermediate portion 24. The cover plate further includes a pair of side flanges 26 upwardly protruding from back portion 22 of the cover plate 18 and having a substantially triangular shape with a top edge 28 merging with front portion 20 of the cover plate 18 and with side edges 30 merging with the rear edge 32 of the back portion 22.

A cigarette extinguisher tube 34 is secured to and downwardly depends from front portion 20 of cover plate 18. Tube 34 has a cigarette inlet 36 and a cigarette outlet 38. It is of a diameter to slidably receive a cigarette C.

A pair of transversely aligned and outwardly protruding pivot studs 40 are secured to side flanges 26 near their top edges 28 and removably engage pivot notches 10. The cover 18 is inserted within the top of receptacle 2 with the pivot studs 40 releasably engaging the pivot notches 10. Side flanges 26 have a sliding fit with the side walls 6 and in the closed position of cover 18, front portion 20 rests on the top edge of front end wall 4 and rear edge 32 of back portion 22 together with the rear edges 30 of side flanges 26 abut against the rear end wall 4*a* of receptacle 2.

Finally, the lower outlet end 38 of tubular extinguisher 34 rests against and is sealed by the cigarette extinguisher closure plate 14. In the closed position of cover 18, front portion 20 is substantially parallel to bottom wall 3 while back portion 22 is rearwardly, downwardly inclined to form with the side flanges 26 and the rear end wall 4*a* of receptacle 2 an ash receiving compartment, for instance, for receiving ashes dropped from a cigarette C held within the cigarette holding notch 8.

In the closed position, the cover 18 completely seals the bottom compartment of receptacle 2, used for storing cigarette ashes and butts. In the closed position of cover 18, extinguisher tube 34 is closed by the closure plate 14. A cigarette can be inserted within tube 34 and its lighted end abuts against closure plate 14, lack of oxygen extinguishes quickly the cigarette.

Figure 4:
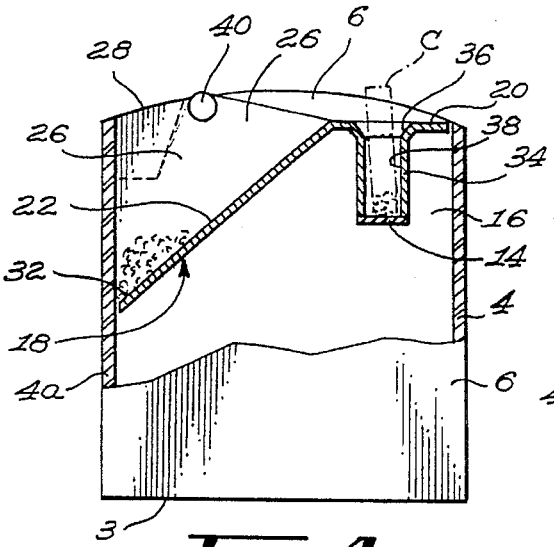
FIGS. 4 and 5 are vertical sections of the first embodiment showing the cover and extinguisher unit in closed and open positions respectively.
Figure 5:
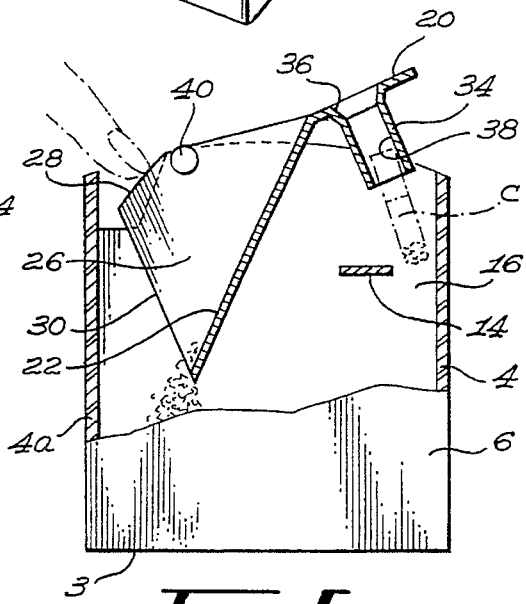
Figure 6:
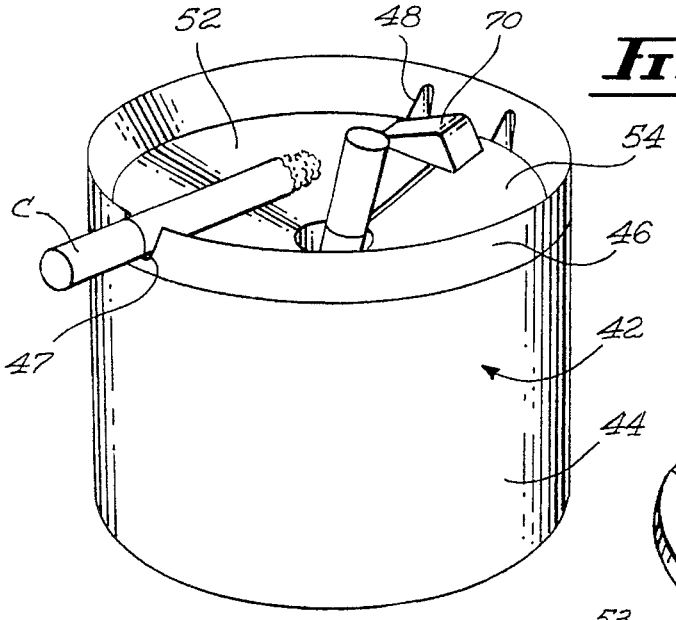
FIG. 6 is a perspective view of a second embodiment of the invention.

The cover 18 is pivoted about pivot studs 40 to an open position, as shown in full line in FIG. 4 wherein, in a simultaneous operation, the rear edge 32 of cover portion 22 moves away from rear end wall 4*a* to discharge the cigarette ashes and the bottom of tube 34 moves upwardly and away from closure plate 14 and tube 34 becomes aligned with passage 16 whereby the cigarette C within tube 34 is automatically discharged by gravity through the open tube outlet 38 and passage 16. The cigarette drops within the bottom of the receptacle 2.

It is noted that the top portion of side flanges 26 are exposed at the finger notches 12 so that a user's finger can be pressed down on the top edge of a side flange 26 to pivot cover 18 to open position. Since the centre of gravity of the cover and extinguisher tube assembly is located forwardly of the pivot studs 40, the cover and tube assembly automatically returns to cover and extinguisher tube closed position after release of the same by the user.

FIGS. 6 to 9 show the second embodiment in accordance with the invention operating on the same principles. An open top receptacle 42 with a cylindrical side wall 44 is fitted with a ring 46 removably supported on the top edge of cylindrical wall 4. The ring 46 may have one or more cigarette holding notches 47. It is also formed with two pairs of opposed pivot notches 48. A cover and extinguisher assembly 50 is formed of two complementary cover plate sections and two complementary extinguisher portions. More particularly, assembly 50 comprises complementary male cover plate section 52 having a pair of opposed pivot studs 53 and a complementary female cover plate section 54 having opposed pivot studs 55. The two complementary cover plate sections 52, 54 form, when assembled, a disc of a diameter to slidably fit within the ring 46 with the pivot studs 53, 55 releasably engaging the pivot notches 48 of ring 46.

The extinguisher tube is made of two mating, semi-tubular portions, namely portion 56 depending from male cover plate section 52 and semi-tubular portion 58 depending from female cover plate section 54.

Each semi-tubular portion 56 and 58 carries at its lower end and normal thereto a half closure plate 60, of semi-circular shape. Male cover plate section 52 has a junction edge 62 which joins with the junction edge 64 of female cover plate section 54. Semi-tubular portion 56 with its half closure plate 60 defines a junction edge 66 which forms a joint with the junction edges 68 of semi-tubular portion 58 and its half closure plate 60 in the closed position of the cover and extinguisher assembly 30. When said joined together portions 56, 58 form a complete tube having a fully open inlet and an outlet closed by the half closure plates 60.

Figure 9:
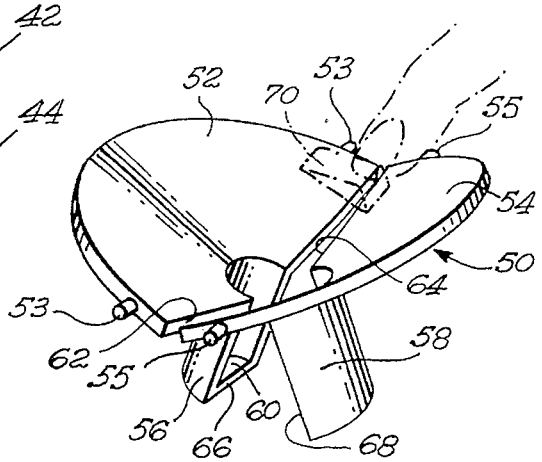
FIG. 9 is a perspective view of the unit of FIG. 9 but shown in open position.
Figure 7:
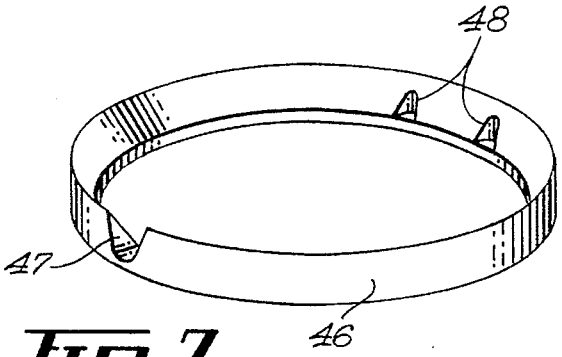
FIG. 7 is a perspective view of the protective edge cover for the receptacle of the invention.

An actuator block 70 is fixed on top of the male cover plate section 52 and overlaps the female cover plate section 54. As shown in FIG. 9, the assembly 50 can be opened by pressing down on actuator block 70 with a finger whereby the centre of the cover assembly moves down and the half-tubular portions 56, 58 open up. Upon release of the actuator block 70, the assembly 50 is biased to automatically return to its receptacle closing position because the centre of gravity of each complementary section 52, 54 together with their half-tubular portions 56, 58 and half-closure plates 60 lie on the outside of the respective pivot studs 53, 55.

During smoking, the cigarette C may be tapped on the ring 46 or held in notch 47 so that the ashes collect on top of the closed cover assembly 50. The cigarette may be completely extinguished by insertion into the extinguisher formed by the mating, semi-tubular portions 56, 58 which are closed at their bottom end by the half-closure plates 60. After cigarette butt extinguishing, the actuator block 70 is pressed down to open the assembly, the ashes collected on top of the cover are dropped within the bottom of receptacle 42 and simultaneously the cigarette butt within down under gravity through the open lower end of the extinguisher.

Figure 10:
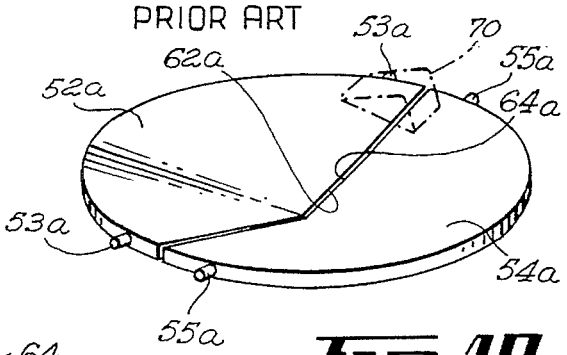
FIG. 10 is a perspective view of a prior art sealing cover.
Figure 8:
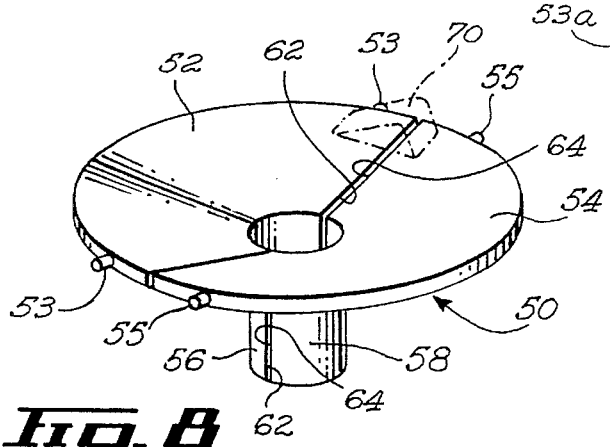
FIG. 8 is a perspective view of the sealing cover and extinguisher unit in closed position.

It is noted, as shown in FIG. 10, that it is known in the prior art to provide a cover made of complementary male and female sections which pivot open by pressing down on an actuator block but this cover is not combined with a cigarette extinguisher.

In FIG. 10, the parts similar to the cover of the invention are denoted by the same reference numerals with the addition of the suffix "a".

The embodiments of the invention, in which an exclusive property or privilege is claimed, are defined as follows:

1. An ashtray with a cigarette extinguisher comprising an ash and cigarette butts receptacle having a receptacle upper portion, a receptacle closure, pivot means for pivoting said receptacle closure to said receptacle upper portion for pivoting between a closed position closing said receptacle and an open position giving access to said receptacle, biasing means biasing said cover to closed position, a tubular cigarette extinguisher carried by said receptacle closure and having an inlet end and an outlet end directed toward the inside of said receptacle, and an extinguisher closure at said outlet end, said extinguisher closure closing said outlet end when said receptacle closure is in closed position and opening said outlet end when said receptacle closure is in open position whereby a cigarette can be inserted into said tubular extinguisher to abut said extinguisher closure and become extinguished when both closures are in closed position and the extinguished cigarette can be discharged from said extinguisher through said outlet end directly into said receptacle when said first closure is in open position.

2. An ashtray with cigarette extinguisher as defined in claim 1, wherein said biasing means are formed by the offset of the centre of gravity of said receptacle closure relative to said pivot means.

3. An ashtray with cigarette extinguisher as defined in claim 1, wherein said receptacle closure is a single cover plate and said tubular extinguisher is a tube having fully opened inlet and outlet ends and downwardly depending from one end of said cover plate and said extinguisher closure is a closure plate secured to and extending within said receptacle below said cover plate and in a position closing the outlet end of said tube when said cover plate is in receptacle closing position, said outlet end directed towards the inside of said receptacle and sufficiently spaced from said closure plate to permit said cigarette discharge when said cover plate is in open position.

4. An ashtray with cigarette extinguisher as defined in claim 3, wherein said receptacle has spaced front and back walls, the pivot axis of said cover plate is transverse to said walls, a cigarette passage is defined between said closure plate and said front wall and said outlet end abuts said closure plate when said cover plate is in closed position and is aligned with said passage when said cover plate is in open position.

5. An ashtray with cigarette extinguisher as defined in claim 4 wherein said cover plate has a front and a back portion at an angle to each other, said tube is carried by and downwardly depend from said front portion, and said back portion is downwardly inclined away from said front portion and abuts said back wall and said front portion abuts said front wall when said cover plate is in closed position.

6. An ashtray with cigarette extinguisher as defined in claim 5, wherein said closure plate has side flanges upwardly extending from opposite sides thereof.

7. An ashtray with cigarette extinguisher as defined in claim 6, wherein said receptacle has side walls with which said side flanges of said closure plate are in slidable contact.

8. An ashtray with cigarette extinguisher as defined in claim 7, wherein at least one of side walls has a top notch exposing the upper part of one of said side flanges to permit a user's finger to press down on said exposed upper part and pivot said closure plate to open position.

9. An ashtray with cigarette extinguisher as defined in claim 8, wherein said receptacle has a rectangular planar cross-section with said front and back walls being narrower than said side walls, and said pivot means including pivot studs outwardly protruding from the upper part of said side flanges of said closure plate and pivot notches at the upper edges of said side walls releasably receiving said pivot studs whereby said cover plate and depending tube can be bodily removed from said receptacle.

10. An ashtray with cigarette extinguisher as defined in claim 1, wherein said receptacle closure is composed of a pair of contiguous cover plates respectively pivoted onto said receptacle by said pivot means, said cover plates having junction edges which join to form a closed joint in the closed position of said receptacle closure and which are spaced apart in the open position of said receptacle closure, said extinguisher is formed of two similar semi-tubular portions and said second closure is formed of two similar half closure plates normal to and fixed to the lower end of the respective semi-tubular portions and said semi-tubular portions and half closure plates having junction edges which join to form a closed joint in the closed position of said receptacle closure and which are spaced apart in the open position of said receptacle closure.

* * * * *